US005833185A

United States Patent [19]

Bradley

[11] Patent Number: 5,833,185

[45] Date of Patent: Nov. 10, 1998

[54] SAW CADDY

[76] Inventor: Carl E. Bradley, 1515 N. Main, Nevada, Mo. 64772

[21] Appl. No.: 651,400

[22] Filed: May 22, 1996

[51] Int. Cl.[6] ..... E04G 5/06

[52] U.S. Cl. ..... 248/220.21; 248/176.1; 211/70.6

[58] Field of Search ..... 248/220.21, 176.1, 248/309.1; 211/70.6

[56] References Cited

U.S. PATENT DOCUMENTS

| | | | |
|---|---|---|---|
| D. 344,347 | 2/1994 | Wittman | D25/67 |
| 2,636,526 | 4/1953 | Madden . | |
| 3,586,077 | 6/1971 | Pease | 143/6 G |
| 3,830,130 | 8/1974 | Moore | 83/745 |
| 4,036,463 | 7/1977 | Hopkins et al. | 248/210 |
| 4,365,720 | 12/1982 | Kaneshiro | 211/60 T |
| 4,453,438 | 6/1984 | Zelli | 83/375 |
| 4,550,803 | 11/1985 | Finster et al. | 182/129 |
| 5,078,353 | 1/1992 | Linn | 248/166 |
| 5,205,422 | 4/1993 | Morris | 211/70.6 |

*Primary Examiner*—Leslie A. Braun
*Assistant Examiner*—Kimberly T. Wood
*Attorney, Agent, or Firm*—Hovey, Williams, Timmons & Collins

[57] ABSTRACT

A support apparatus for supporting a tool adjacent a workstation, wherein the tool has a substantially flat table and a working element projecting outwardly from the table, includes a shelf assembly which has a support surface and an adjacent stop edge. Structure is provided for mounting the shelf assembly to the workstation. The support surface is configured for engaging and supporting a section of the table, with the working element extending along the stop edge and with the center of gravity of the tool over the support surface. The structure for mounting the shelf assembly to the workstation includes structure for positioning the support surface at an angle, relative to horizontal, for preventing the tool from sliding from the support surface.

36 Claims, 1 Drawing Sheet

SAW CADDY

BACKGROUND OF THE INVENTION

1. Field of the Invention

The present invention relates generally to tool holders and supports for supporting tools adjacent a workstation, such as a sawhorse. More particularly, the present invention is concerned with a support apparatus for supporting a tool adjacent a workstation, wherein the apparatus includes a shelf assembly having a support surface and an adjacent stop edge, and structure for mounting the shelf assembly to the workstation with the support surface positioned at an angle relative to horizontal. A tool, having a substantially flat table and a working element projecting outwardly from the table, may be supported on the shelf assembly in a manner to prevent sliding of the tool from the assembly by placing the table in supporting engagement with the support surface, with the center of gravity of the tool being over the support surface and the working element extending along the stop edge.

2. Discussion of Prior Art

Power tools and manually operated tools have various applications and are widely utilized by tradesmen and artisans, such as carpenters, construction workers, hobbyists, etc. A number of tools have a common configuration, including a substantially flat table which is placed against the structure to be machined or worked by the tool and a working element or tool element projecting outwardly from the table (most often from the underside of table) for machining or working the structure. Such tools typically have a center of gravity offset to one side of the working element over a section of the table. For example, a portable circular saw presents such a configuration, with a table and a generally circular, rotatable blade projecting outwardly from the table to present a working portion for cutting the structure against which the table is placed. Other tools having a similar configuration include routers and jigsaws.

This configuration tends to render the tool unwieldy. Specifically, the tool is bulky and often has an asymmetrical exterior shape, which makes handling of the tool with one hand or at arms length cumbersome. When the tool is placed on a surface between use or after use, the irregular exterior shape typically requires that the tool be laid on its side or upside down. It will be appreciated that the tools are also placed in such positions to protect the working element projecting outwardly from the table. In either instance, since the handle or gripping portion is not readily graspable, picking the tool up becomes relatively difficult and time consuming. Additionally, in order to prevent injury, the user must not carelessly pick up the tool since the trigger or control switch for controlling operation of the tool is often adjacent the handle or gripping portion.

Complicating matters is the tendency to utilize such a tool in applications which require quick and frequent access to the tool. In carpentry or construction applications, a single piece of wood lumber may be cut or shaped several times. Furthermore, the tool is often utilized at a work station that has little or no space for temporary storage (i.e., between use storage) of the tool. Consequently, the tool is often set on the ground or at a location remote from the workstation. For example, workstations often comprise a sawhorse or pair of sawhorses, upon which a piece of lumber is placed. Of course, the sawhorses present very little, if any, space for resting a tool between uses, especially when the piece of lumber is being moved and manipulated across the top of the sawhorses during the tooling process. The user often faces the dilemma of placing the tool on the ground, which exposes the tool to dirt and other debris, or placing the tool on the working surface of the workstation, which exposes the tool to particles of scrap material such as sawdust. Of course, these elements are detrimental to operation of the tool.

There have been attempts to provide an apparatus which supports such a tool adjacent the workstation in a convenient, yet out-of-the-way location, so that the tool may be accessed quickly and safely. However, a conventional support apparatus typically has a specific design corresponding to a particular tool, whereby the apparatus is not configured for supporting variously constructed tools. That is to say, although the tools discussed above have generally similar designs, conventional support apparatuses usually are specifically constructed to support a specific type of tool. For example, a conventional support apparatus is often designed to support either a portable circular saw or a jigsaw, but not both. Furthermore, the construction of support apparatuses for the same type of tool, such as a portable circular saw, may vary among different tool manufacturers so that the apparatuses are unable to support another manufacturer's tool. Conventional support apparatuses are also often configured for attachment to one type of workstation, such as a sawhorse or a shop bench. Accordingly, traditional support apparatuses are not versatile. Furthermore, traditional support apparatuses tend to have relatively complex and expensive constructions and tend not to be sufficiently durable to withstand the rigorous operating conditions associated with most tool applications.

SUMMARY OF THE INVENTION

Responsive to these problems, the invention provides a support apparatus for supporting a tool adjacent a workstation, wherein the tool has a substantially flat table and a working element projecting outwardly from the table. The table presents a support section that is on the same side of the working element as the center of gravity of the tool. The support apparatus includes a shelf assembly which has a support surface and an adjacent stop edge. Structure is provided for mounting the shelf assembly to the workstation. The support surface is configured for engaging and supporting the table section and thereby the tool, with the working element extending along the stop edge and with the center of gravity over the support surface. The structure for mounting the shelf assembly to the workstation includes positioning means for positioning the support surface at an angle, relative to horizontal, for preventing the tool from sliding from the support surface. Preferably, the support apparatus is configured especially for supporting a portable circular saw on a sawhorse.

The preferred support surface has opposite proximal and terminal ends, with the proximal end being adjacent the mounting means and the stop edge extending between the ends. The angle of the surface preferably has a pitch component, with the support surface angling downwardly from the terminal end toward the proximal end, and a roll component, with the support surface angling upwardly toward the stop edge. In this respect, the mounting means includes restriction means for restricting movement of the tool along the support surface beyond the proximal end. The preferred restriction means including a bracket adjacent the proximal end of the support surface, with the bracket being configured to abuttingly engage the tool when the latter is supported by the support face. The stop edge is configured to abuttingly engage the working element of the tool for further restricting movement of the tool along the support surface. The pitch component and roll component of the angled support surface are no less than approximately 5° relative to horizontal and preferably are approximately 15° relative to horizontal.

The preferred bracket also serves to connect to the shelf assembly to the workstation. The preferred positioning means includes an elongated coupling member projecting from the shelf assembly adjacent the proximal end of the support surface, and a corresponding elongated slot defined within the bracket and disposed at a second angle relative to horizontal when the bracket is connected to the workstation. The slot receives the coupling member for defining the roll component of the angled support surface, with the stop edge being configured to abuttingly engage the working element for preventing the tool from sliding from the support surface. The preferred positioning means further includes a leg projecting from the coupling member, with a third angle being defined between the leg and the coupling member. The leg engages the bracket when the coupling member is received within the slot to maintain the pitch component of the angled support surface.

The shelf assembly is preferably reversible so that both left-handed and right-handed tools may be supported by the apparatus. That is to say, the shelf assembly preferably has an opposite pair of stop edges extending between the ends of the support surface, and the bracket is reversibly connectable to the workstation, so that the slot angle is reversible about a vertical axis and thereby the roll component is reversible about a vertical axis. For example, tools having similarly positioned handles, but respective centers of gravity on opposite sides of the working element may both be supported in a similar position by reversing the roll component of the support surface. The shelf assembly is preferably composed of wood or plastic.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
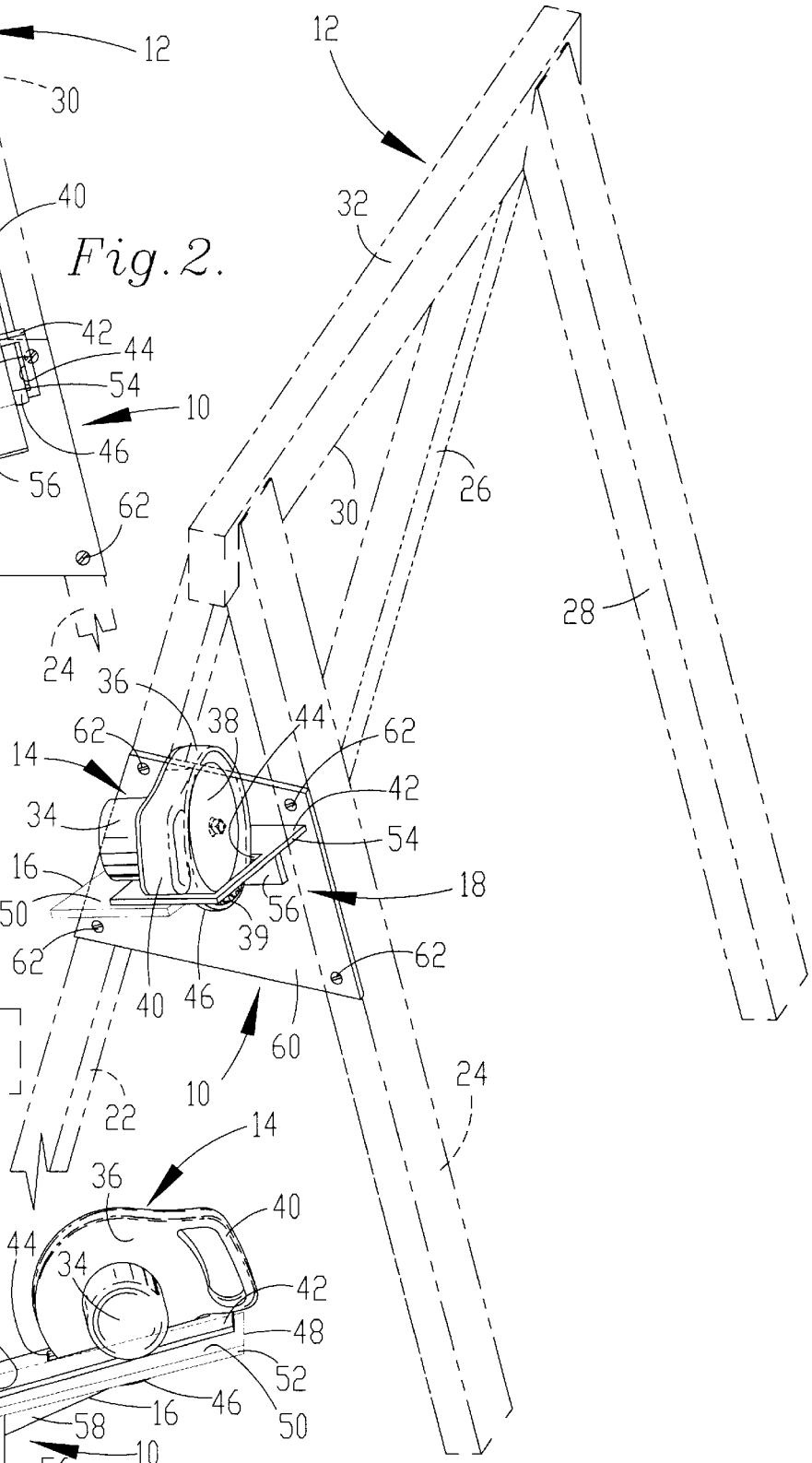
FIG. 1 is a perspective view of a support apparatus constructed in accordance with the preferred embodiment of the present invention mounted to a sawhorse illustrated in phantom for supporting a portable circular saw.

Turning now to the drawings, and particularly FIG. 1, a support apparatus, generally denoted by the numeral 10, is secured to a workstation in the form of a sawhorse 12 for supporting a portable circular saw 14 on sawhorse 12. Support apparatus 10 generally includes a shelf assembly 16 for engaging and supporting saw 14, and mounting means, generally denoted by the numeral 18, for mounting shelf assembly 16 to sawhorse 12. Mounting means 18 includes positioning means, generally denoted by the numeral 20, for positioning shelf assembly 16 in a manner to support the saw 14, as will subsequently be described.

The construction of sawhorse 12 is conventional and well known in the art. It is, therefore, sufficient to explain that sawhorse 12 generally includes two spaced pairs of wooden legs 22,24 and 26,28. Each pair of legs 22,24 or 26,28 converge upwardly and connect to a wooden crossbeam 30 to support crossbeam 30 in an elevated position. Accordingly, crossbeam 30 presents an uppermost surface 32 upon which wood lumber and other materials and items may be placed for disposing the same in a handy and convenient position. It will be appreciated, however, that the principles of the present invention are equally applicable to other variously constructed sawhorses or workstations.

Saw 14 is also conventionally constructed and, as will be understood by those of ordinary skill in the art, generally includes a motor housing 34 for covering an electric motor (not shown) and a blade housing 36 for housing a rotatable circular blade 38 that is selectively driven by the motor. A handle 40 integrally formed with blade housing 36 is gripped by the user for handling and controlling operation of saw 14. Saw 14 also includes a substantially flat table 42 having an undersurface that is placed against the item to be cut by saw 14. Blade 38 extends through an elongated slot 44 defined within table 42 to present a working portion 39 of the saw projecting downwardly from the table for cutting an item against which the table is placed. For protective reasons, working portion 39 includes a guard 46 removably covering the blade 38 in the usual manner. Slot 44 is offset from the center of table 42 so that table 42 has a relatively larger section extending from one side of blade 38. It will be appreciated that saw 14 has a center of gravity positioned on the same side of blade 38 as the electric motor and the relatively larger section of table 42.

Although the illustrated embodiment of the present invention is shown supporting saw 14, it is entirely within the ambit of the present invention to support other similarly constructed tools on apparatus 10. That is to say, support apparatus 10 is highly versatile and therefore may be utilized to support almost any tool having a substantially flat table and a working element projecting outwardly from the table, with the center of gravity of the tool being located on one side of the working element over a section of the table. For example, support apparatus 10 is also particularly useful in supporting a jigsaw.

Turning now to support apparatus 10, shelf assembly 16 includes a generally rectangular shelf plate 48 which presents an upwardly facing, generally flat support surface 50 and opposite side edges 52 and 54 extending between terminal and proximal ends of support surface 50. A bearing plate 56 depends from the proximal end of shelf plate 48, for purposes which will subsequently be described. A triangular-shaped brace 58 connects between shelf plate 48 and bearing plate 56 for transmitting the load forces experienced by shelf plate 48 to bearing plate 56. Shelf assembly 16 is preferably composed of wood, although other suitable materials, such as metal or a high strength plastic material, may be employed.

Mounting means 18 for mounting shelf assembly 16 to sawhorse 12 includes a trapezoidal-shaped bracket 60 fastened to legs 22,24 by a series of wood screws 62. Bracket 60 is preferably constructed of metal, although wood or plastic materials are suitable alternatives. It will be appreciated that bracket 60 serves to brace and reinforce the legs 22,24. Additionally, the trapezoidal shape of bracket 60 fits conveniently to the converging configuration of legs 22,24, whereby the converging sides of bracket 60 allow the bracket to be easily aligned and leveled when connected to the legs, assuming the legs are properly connected to crossbeam 30. In other words, when bracket 60 is connected to sawhorse 12, the user simply needs to align the sides of bracket 60 with the corresponding outer edges of legs 22,24 for leveling the bracket. Of course, if legs 22,24 do not converge at equal angles toward crossbeam 30, connection of bracket 60 to sawhorse 12 simply requires that a bubble level (not shown) or other suitable means be utilized for leveling the bracket.

Positioning means 20 are provided for positioning support surface 50 at an angle, relative to horizontal, for preventing saw 14 from sliding from support surface 50. Specifically, positioning means 20 includes an elongated slot 64 defined within bracket 60 (see FIG. 3). It will be appreciated that slot 64 is disposed at an angle relative to horizontal. An elongated coupling member 66 projecting from the proximal end of shelf plate 48 is removably received within slot 64. Coupling member 66 has a longitudinal axis that is substantially parallel to support surface 50 and generally aligned with the longitudinal axis of slot 64, when received therein, so that support surface 50 is disposed at substantially the same angle as slot 64. In other words, the angle of support surface 50 has a roll component, with support surface 50 sloping upwardly from side edge 52 toward side edge 54, that is defined by the angle at which slot 64 is disposed (see FIGS. 1 and 2).

Figure 3:
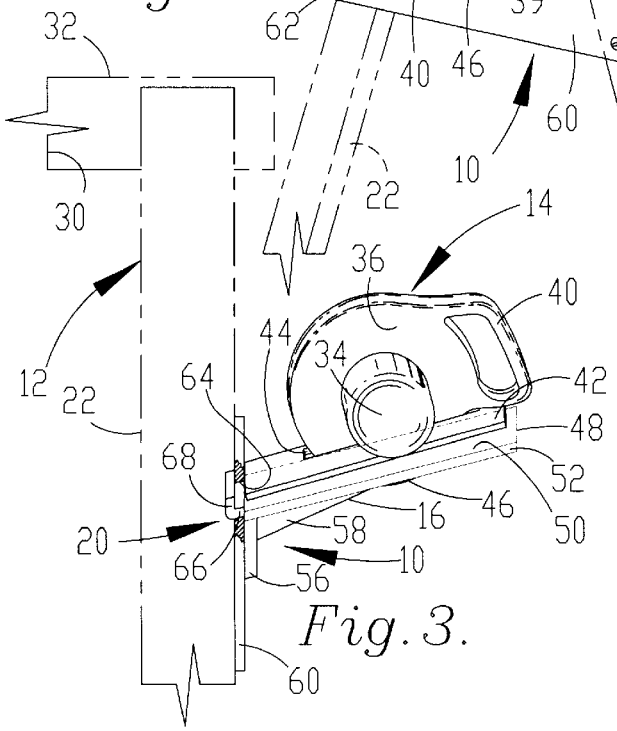
FIG. 3 is an enlarged fragmentary, side perspective view of the support apparatus illustrated in FIG. 1, particularly illustrating the roll component of the angled support surface and the structure for positioning the shelf assembly at the desired angle.

As shown in FIG. 3, positioning means 20 further includes a leg 68 projecting from the end of coupling member 66 at an angle relative thereto. When coupling member 66 is received within slot 64 and aligned therewith, leg 68 abuttingly engages the rear side (leftward side when viewing FIG. 3) of bracket 60 to maintain a pitch component of the angle of support surface 50, with the support surface sloping downwardly from the terminal end toward the proximal end. That is to say, support surface 50 is maintained at an angle relative to vertical that is generally equal to the angle defined between coupling member 66 and leg 68, because of the interengagement of bracket 60 and leg 68. Bearing plate 56 is connected to shelf plate 48 at an angle corresponding to the pitch component of the angled support surface 50 (i.e., generally equal to the angle defined between coupling member 66 and leg 68) so that when bearing plate 56 bears against bracket 60, bearing plate 56 and brace 58 assist with maintaining support surface 50 in the illustrated orientation.

With the pitch and roll components of the angled support surface, the surface slopes generally downwardly toward the corner defined between side edge 52 and the proximal end of the surface (fowardmost and leftwardmost corner of support surface 50 illustrated in FIG. 3). If desired, the angle of support surface 50 may comprise only one of the previously described pitch and roll components, if the other component is approximately 0° relative to horizontal. For example, the angle of support surface 50 may have a pitch component of 15° relative to horizontal with a roll component of 0° relative to horizontal, whereby the surface extends upwardly from side edge 52 toward side edge 54 but is substantially horizontal from end-to-end. However, it is critical that support surface 50 be positioned at an angle relative to horizontal for preventing inadvertent removal of saw 14. Furthermore, it has been determined that the minimum critical angle for either the pitch component or roll component is approximately 5° relative to horizontal. In other words, the pitch component or roll component of the angle of support surface 50 must be equal to or greater than approximately 5° relative to horizontal. In the illustrated embodiment, both the pitch component and the roll component are approximately 15° relative to horizontal.

In use, saw 14 is placed upon angled support surface 50 in the illustrated manner, with support surface 50 engaging and supporting the relatively larger section of table 42 and with the center of gravity of the tool over support surface 50. Because of the pitch component of the angle of support surface 50, gravity urges saw 14 toward bracket 60, yet bracket 60 abuttingly engages saw table 42 for restricting the saw from sliding leftwardly (viewing FIG. 3) beyond the proximal end of support surface 50. In a similar manner, although saw 14 is urged downwardly toward side edge 52, side edge 54 serves as a stop edge for abuttingly engaging guard 46 (see FIG. 2) for preventing saw 14 from sliding downwardly toward side edge 52 and from support surface 50.

In view of the foregoing description of a preferred embodiment of the present invention, it will be appreciated that support apparatus 10 is particularly useful in retaining saw 14 adjacent sawhorse 12. The preferred pitch and roll components of the angle of support surface 50 have also proven particularly effective in preventing inadvertent removal of saw 14 from support surface 50 when saw 14 is jarred or bumped during the tooling process. Additionally, the illustrated angle of support surface 50 has proven to retain saw 14 thereon at most floor and ground slopes, although the pitch and roll components of the angle of support surface 50 may be adjusted as necessary. As perhaps best shown in FIGS. 1 and 3, saw 14 is supported in an orientation by apparatus 10 that places handle 40 in a convenient, readily graspable location, yet saw 14 is positioned away from the uppermost surface 32 of sawhorse 12 so that saw 14 is prevented from interfering with manipulation of items along surface 32. Accordingly, the present invention has the potential to increase efficiency and productivity of the user. Support apparatus 10 also positions saw 14 in a location that is not subject to inordinate amounts of sawdust, dirt and other debris. Furthermore, support apparatus 10 has a relatively simple, durable and inexpensive construction.

Figure 2:
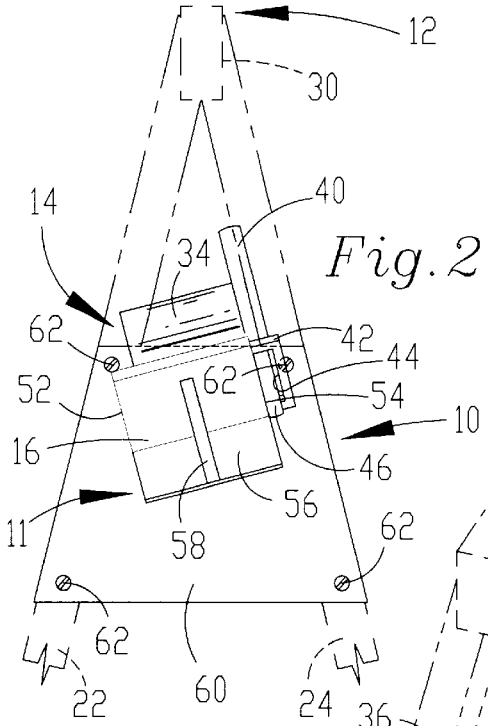
FIG. 2 is an enlarged, fragmentary, perspective view taken from under the support apparatus illustrated in FIG. 1, particularly illustrating the pitch component of the angled support surface of the apparatus.

It will also be appreciated that the roll component of the angle of support surface 50 is reversible so that the support surface may be positioned to slope upwardly from side edge 54 toward side edge 52; that is to say, the roll component of support surface 50 may be reversed so that the surface rises from side-to-side in an opposite direction than illustrated in FIGS. 1–3. To reverse the roll component of support surface 50, shelf assembly 16 is disconnected from bracket 60 by tilting the former in a counterclockwise direction (viewing FIG. 3) so that coupling member 66 and leg 68 may be removed from slot 64. Bracket 60 is detached from sawhorse 12 by unfastening wood screws 62. Bracket 60 is subsequently reversed so that the angle of slot 64 is reversed about a vertical axis, and the bracket is finally reattached to the sawhorse. Shelf assembly 16 is reconnected to bracket 60, with support surface 50 sloping upwardly toward side edge 52. Accordingly, a saw having a handle extending from the opposite side of the blade (i.e., leftward side viewing FIG. 3) may be supported on support surface 50 with the handle directed outwardly, rather than the handle being inconveniently positioned adjacent the bracket 60. With the reversed configuration of support surface 50, side edge 52 serves as the stop edge for abuttingly engaging the guard 46 to prevent saw 14 from sliding from support surface 50.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set out in the following claims.

What is claimed is:

1. A support apparatus for supporting a tool adjacent a workstation, wherein the tool has a substantially flat table and a working element projecting outwardly from the table, with the table presenting a support section on the same side of the working element as a center of gravity of the tool, said support apparatus comprising:

a shelf assembly having a stop edge and a substantially flat support surface projecting from said stop edge; and mounting means for mounting said shelf assembly to the workstation, said support surface being configured for engaging and supporting the table support section and thereby the tool with the working element extending along said stop edge and with the center of gravity over said support surface, said mounting means including positioning means for positioning said support surface at an angle relative to horizontal for preventing the tool from sliding from said support surface;

said support surface having opposite proximal and terminal ends, with said proximal end being adjacent said mounting means and with said stop edge extending between said ends, said angle having a pitch component with said support surface angling downwardly from said terminal end toward said proximal end, said mounting means including restriction means for restricting movement of the tool along said support surface beyond said proximal end.

2. A support apparatus as claimed in claim 1, said angle having a roll component with said support surface angling upwardly toward said stop edge, said stop edge being configured to abuttingly engage the working element for preventing the tool from sliding from said support surface.

3. A support apparatus as claimed in claim 1, said restriction means including a bracket adjacent said proximal end of said support surface, said bracket being configured to abuttingly engage the tool when the latter is supported by said support face.

4. A support apparatus as claimed in claim 1, said angle having a roll component with said support surface angling upwardly toward said stop edge, said stop edge being configured to abuttingly engage the working element for further restricting movement of the tool along said support surface.

5. A support apparatus as claimed in claim 4, said pitch component and said roll component being no less than approximately 5° relative to horizontal.

6. A support apparatus as claimed in claim 5, said pitch component and said roll component being approximately 15° relative to horizontal.

7. A support apparatus as claimed in claim 1, said shelf assembly being composed of wood.

8. A support apparatus as claimed in claim 1, said shelf assembly being composed of a plastic material.

9. A support apparatus for supporting a tool adjacent a workstation, wherein the tool has a substantially flat table and a working element projecting outwardly from the table, with the table presenting a support section on the same side of a working element as the center of gravity of the tool, said support apparatus comprising:

a shelf assembly having a support surface and an adjacent stop edge; and mounting means for mounting said shelf assembly to the workstation, said support surface being configured for engaging and supporting the table support section and thereby the tool with the working element extending along said stop edge and with the center of gravity over said support surface, said mounting means including positioning means for positioning said support surface at an angle relative to horizontal for preventing the tool from sliding from said support surface, said mounting means including a bracket connectable to the workstation, said support surface having opposite proximal and terminal ends, with said proximal end being adjacent said bracket and with said stop edge extending between said ends, said positioning means including an elongated coupling member projecting from said shelf assembly adjacent said proximal end, and a corresponding elongated slot defined within said bracket and disposed at a second angle relative to horizontal when said bracket is connected to the workstation, said slot receiving said coupling member for defining a roll component of said angle of said support surface with said support surface angling upwardly toward said stop edge, said stop edge being configured to abuttingly engage the working element for preventing the tool from sliding from said support surface.

10. A support apparatus as claimed in claim 9, said shelf assembly having an opposite pair of said stop edges extending between said ends of the support surface, said bracket being reversibly connectable to the workstation so that said second angle is reversible about a vertical axis and thereby said roll component is reversible about a vertical axis.

11. A support apparatus as claimed in claim 9, said positioning means including a leg projecting from said coupling member, with a third angle being defined between said leg and said coupling member, said leg engaging said bracket when said coupling member is received within said slot to maintain a pitch component of said angle of said support surface with said support surface angling downwardly from said terminal end toward said proximal end, said bracket being configured for abuttingly engaging the tool when the latter is supported by the support surface to restrict movement of the tool along said support surface beyond said proximal end.

12. A support apparatus as claimed in claim 1, the workstation comprising a sawhorse having two spaced pairs of legs, said mounting means including a rigid bracket connectable between one of the pairs of legs for bracing the one pair of legs.

13. A portable circular saw support apparatus for supporting a portable circular saw adjacent a workstation, wherein the saw includes a table and a generally circular, rotatable blade having a working portion projecting outwardly from the table, with the table presenting a support section on the same side of a blade as the center of gravity of the saw, said saw support apparatus comprising:

a shelf assembly having a stop edge and a substantially flat support surface projecting from said stop edge; and mounting means for mounting said shelf assembly to the workstation, said support surface being configured for engaging and supporting the table support section and thereby the saw with the working portion extending along said stop edge and with the center of gravity over said support surface, said mounting means including positioning means for positioning said support surface at an angle relative to horizontal for preventing the saw from sliding from said support surfaces, said support surface having opposite proximal and terminal ends, with said proximal end being adjacent said mounting means and with said stop edge extending between said ends, said angle having a pitch component with said support surface angling downwardly from said terminal end toward said proximal end, said mounting means including restriction means for restricting movement of the saw along said support surface beyond said proximal end.

14. A saw support apparatus as claimed in claim 13, said angle having a roll component with said support surface angling upwardly toward said stop edge, said stop edge being configured to abuttingly engage the working portion for preventing the saw from sliding from said support surface.

15. A saw support apparatus as claimed in claim 13, said restriction means including a bracket adjacent said proximal end of said support surface, said bracket being configured to abuttingly engage the saw when the latter is supported by said support face.

16. A saw support apparatus as claimed in claim 13, said angle having a roll component with said support surface angling upwardly toward said stop edge, said stop edge being configured to abuttingly engage the working portion for further restricting movement of the saw along said support surface.

17. A saw support apparatus as claimed in claim 16, said pitch component and said roll component being no less than approximately 5° relative to horizontal.

18. A saw support apparatus as claimed in claim 17, said pitch component and said roll component being approximately 15° relative to horizontal.

19. A saw support apparatus as claimed in claim 13, said shelf assembly being composed of wood.

20. A saw support apparatus as claimed in claim 13, said shelf assembly being composed of a plastic material.

21. A saw support apparatus for supporting a portable circular saw adjacent a workstation, wherein the saw includes a table and a generally circular, rotatable blade having a working portion projecting outwardly from the table, with the table presenting a support section on a same side of the blade as the center of gravity of the saw, said saw support apparatus comprising:

a shelf assembly having a support surface and an adjacent stop edge; and mounting means for mounting said shelf assembly to the workstation, said support surface being configured for engaging and supporting the table support section and thereby the saw with the working portion extending along said stop edge and with the center of gravity over said support surface, said mounting means including positioning means for positioning said support surface at an angle relative to horizontal for preventing the saw from sliding from said support surface, said mounting means including a bracket connectable to the workstation, said support surface having opposite proximal and terminal ends, with said proximal end being adjacent said bracket and with said stop edge extending between said ends, said positioning means including an elongated coupling member projecting from said shelf assembly adjacent said proximal ends, and a corresponding elongated slot defined within said bracket and disposed at a second angle relative to horizontal when said bracket is connected to the workstation, said slot receiving said coupling member for defining a roll component of said angle of said support surface with said support surface angling upwardly toward said stop edge, said stop edge being configured to abuttingly engage the working portion of the blade for preventing the saw from sliding from said support surface.

22. A saw support apparatus as claimed in claim 21, said shelf assembly having an opposite pair of said stop edges extending between said ends of the support surface, said bracket being reversibly connectable to the workstation so that said second angle is reversible about a vertical axis and thereby said roll component is reversible about a vertical axis.

23. A saw support apparatus as claimed in claim 21, said positioning means including a leg projecting from said coupling member, with a third angle being defined between said leg and said coupling member, said leg engaging said bracket when said coupling member is received within said slot to maintain a pitch component of said angle of said support surface with said support surface angling downwardly from said terminal end toward said proximal end, said bracket being configured for abuttingly engaging the saw when the latter is supported by the support surface to restrict movement of the saw along said support surface beyond said proximal end.

24. A saw support apparatus as claimed in claim 13, the workstation comprising a sawhorse having two spaced pairs of legs, said mounting means including a rigid bracket connectable between one of the pairs of legs for bracing the one pair of legs.

25. In combination with a sawhorse, a support apparatus for supporting a tool on the sawhorse, wherein the tool has a substantially flat table and a working element projecting outwardly from the table, with the table presenting a support section on the same side of the working element as a center of gravity of the tool, the combination comprising:

a shelf assembly having a stop edge and a substantially flat support surface projecting from said stop edge; and mounting means for mounting said shelf assembly to the sawhorse, said support surface being configured for engaging and supporting the table support section and thereby the tool with the working element extending along said stop edge and with the center of gravity over said support surface, said mounting means including positioning means for positioning said support surface at an angle relative to horizontal for preventing the tool from sliding from said support surface, said support surface having opposite proximal and terminal ends, with said proximal end being adjacent said mounting means and with said stop edge extending between said ends, said angle having a pitch component with support surface angling downwardly from said terminal end toward said proximal end, said mounting means including restriction means for restricting movement of the tool along said support surface beyond said proximal end.

26. In a combination as claimed in claim 25, said angle having a roll component with said support surface angling upwardly toward said stop edge, said stop edge being configured to abuttingly engage the working element for preventing the tool from sliding from said support surface.

27. In a combination as claimed in claim 25, said restriction means including a bracket adjacent said proximal end of said support surface, said bracket being configured to abuttingly engage the tool when the latter is supported by said support face.

28. In a combination as claimed in claim 25, said angle having a roll component with said support surface angling upwardly toward said stop edge, said stop edge being configured to abuttingly engage the working element for further restricting movement of the tool along said support surface.

29. In a combination as claimed in claim 28, said pitch component and said roll component being no less than approximately 5° relative to horizontal.

30. In a combination as claimed in claim 29, said pitch component and said roll component being approximately 15° relative to horizontal.

31. In a combination as claimed in claim 25, said shelf assembly being composed of wood.

32. In a combination as claimed in claim 25, said shelf assembly being composed of a plastic material.

33. In combination with a sawhorse, a support apparatus for supporting a tool on the sawhorse, wherein the tool has a substantially flat table and a working element projecting outwardly from the table, with the table presenting a support section on a same side of the working element as the center of gravity of the tool, the combination comprising:

a shelf assembly having a support surface and an adjacent stop edge; and mounting means for mounting said shelf assembly to the sawhorse, said support surface being configured for engaging and supporting the table support section and thereby the tool with the working element extending along said stop edge and with the center of gravity over said support surface, said mounting means including positioning means for positioning said support surface at an angle relative to horizontal for preventing the tool from sliding from said support surface, said mounting means including a bracket connected to the sawhorse, said support surface having opposite proximal and terminal ends, with said proximal end being adjacent said bracket and with said stop edge extending between said ends, said positioning means including an elongated coupling member projecting from said shelf assembly adjacent said proximal ends, and a corresponding elongated slot defined within said bracket and disposed at a second angle relative to horizontal, said slot receiving said coupling member for defining a roll component of said angle of said support surface with said support surface angling upwardly toward said stop edge, said stop edge being configured to abuttingly engage the working element for preventing the tool from sliding from said support surface.

34. In a combination as claimed in claim 33, said shelf assembly having an opposite pair of said stop edges extending between said ends of the support surface, said bracket being reversibly connected to the workstation so that said second angle is reversible about a vertical axis and thereby said roll component is reversible about a vertical axis.

35. In a combination as claimed in claim 33, said positioning means including a leg projecting from said coupling member, with a third angle being defined between said leg and said coupling member, said leg engaging said bracket when said coupling member is received within said slot to maintain a pitch component of said angle of said support surface with said support surface angling downwardly from said terminal end toward said proximal end, said bracket being configured for abuttingly engaging the tool when the latter is supported by the support surface to restrict movement of the tool along said support surface beyond said proximal end.

36. In a combination as claimed in claim 33, said sawhorse having two spaced pairs of upright legs, said bracket being connected between one of the pairs of legs for bracing the one pair of legs.

* * * * *